US006164938A

United States Patent [19]

Chuang

[11] Patent Number: 6,164,938

[45] Date of Patent: Dec. 26, 2000

[54] HAND PUMP WITH AUTOMATIC AND MANUAL INFLATION DEVICES

[76] Inventor: Louis Chuang, P.O. Box 63-247, Taichung, Taiwan

[21] Appl. No.: 09/375,106

[22] Filed: Aug. 16, 1999

[51] Int. Cl.[7] ..... F04B 39/10

[52] U.S. Cl. ..... 417/569; 417/572; 417/234; 222/5

[58] Field of Search ..... 417/53, 572, 569, 417/504, 234; 222/5, 6; 137/355.17, 231, 38

[56] References Cited

U.S. PATENT DOCUMENTS

| | | | |
|---|---|---|---|
| 4,569,275 | 2/1986 | Brunet | 92/58.1 |
| 5,316,055 | 5/1994 | Brimmer | 141/38 |
| 5,911,520 | 6/1999 | Kenney | 4/615 |

*Primary Examiner*—Timothy S. Thorpe
*Assistant Examiner*—Timothy P. Solak
*Attorney, Agent, or Firm*—Alan Kamrath

[57] ABSTRACT

A hand pump includes a cylinder, a head mounted to a first end of the cylinder and including a compartment communicated with a bore of the cylinder, and a piston rod including a first end reciprocatingly received in the bore of the cylinder and a second end beyond a second end of the cylinder. The piston rod includes a chamber for receiving a gas container therein. An automatic inflation device is attached to the second end of the piston rod and includes a valve engaging arrangement to be optionally engaged with a valve of an object to be inflated. A pin is provided to open the gas container in the chamber of the piston rod such that gas from the gas container is guided to an outlet of the automatic inflation device. A manual inflation device is mounted in the head for optionally engaging with the valve of the object to be inflated. The automatic inflation device is capable of acting as a handle to proceed with manual inflation to the valve of the object to be inflated via the manual inflation device.

12 Claims, 14 Drawing Sheets

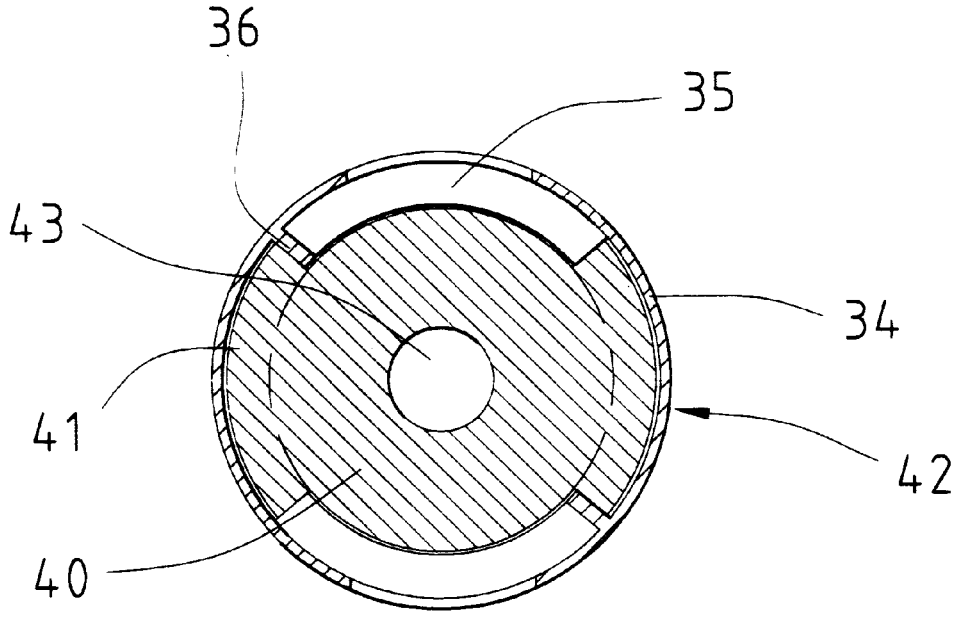
A-A Fig. 4
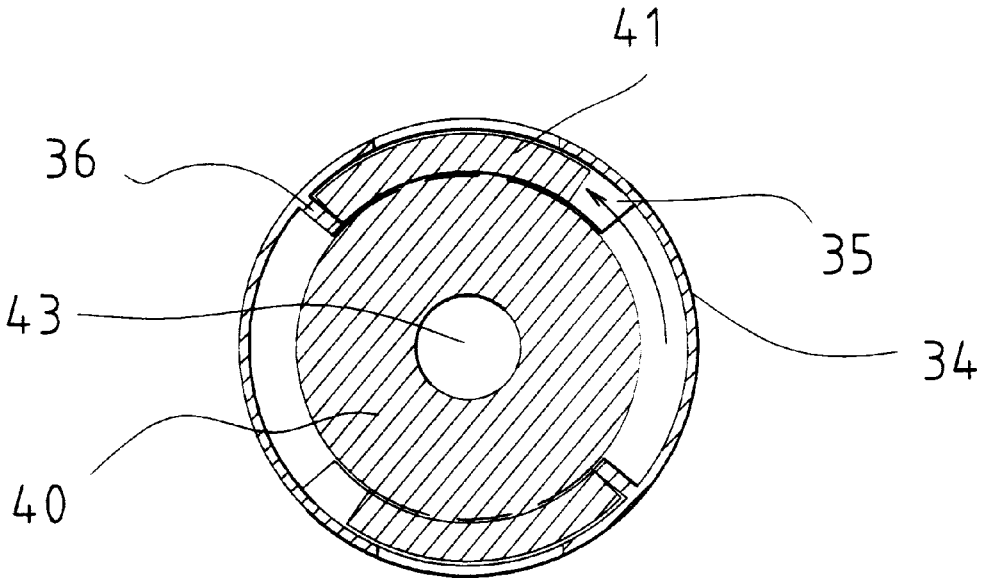
A-A Fig. 5

HAND PUMP WITH AUTOMATIC AND MANUAL INFLATION DEVICES

BACKGROUND OF THE INVENTION

1. Field of the Invention

The present invention relates to a hand pump with an automatic inflation device and a manual inflation device to provide convenient optional choice to the user.

2. Description of the Related Art

A typical automatic inflation device includes a gas container containing high-pressure gas (usually carbon dioxide) therein to allow rapid inflation. The gas container can be used only once. Namely, the user must replace a new one when the original container is used (opened), yet the user often forgets to do so.

The present invention is intended to provide a hand pump with both automatic and manual devices that mitigates and/or obviates the above problems.

SUMMARY OF THE INVENTION

It is a primary object of the present invention to provide a hand pump with an automatic inflation device and a manual inflation device to provide convenient optional choice to the user. The manual inflation device allows the hand pump to perform manual inflation operation when the automatic inflation device malfunctions or the user forgot to replace a new gas container after previous use.

A hand pump in accordance with the present invention comprises:

- a cylinder including a first end and a second end, the cylinder further including a bore therein;
- a head mounted to the first end of the cylinder and including a compartment communicated with the bore of the cylinder;
- a piston rod including a first end reciprocatingly received in the bore of the cylinder and a second end beyond the second end of the cylinder, the piston rod including a chamber for receiving a gas container therein;
- an automatic inflation device attached to the second end of the piston rod, the automatic inflation device including:
  - a valve engaging means adapted to be optionally engaged with a valve of an object to be inflated,
  - means for opening the gas container in the chamber of the piston rod; and
  - means for guiding gas from the gas container to the valve; and
- a manual inflation device mounted in the head and adapted to be optionally engaged with the valve of the object to be inflated;
- whereby the automatic inflation device is capable of acting as a handle to proceed with manual inflation to the valve of the object to be inflated via the manual inflation device.

The second end of the cylinder includes an inner flange for preventing disengagement of the first end of the piston rod from the cylinder. In an alternative design of the invention, the cylinder includes a sleeve ring threadedly engaged on the second end thereof and through which the piston rod extends, the sleeve ring including an inner flange for preventing disengagement of the first end of the piston rod.

The automatic inflation device is releasably engaged with the second end of the piston rod. The second end of the piston rod includes an outer flange having two notch sections separated by two solid sections. Each solid section has a space communicated with the notch sections. The automatic inflation device includes an end with two protrusions that are inserted into the notch sections and then rotated through an angle into the spaces in the solid sections of the outer flange, thereby preventing disengagement between the piston rod and the automatic inflation device.

The automatic inflation device includes a second head having a first end attached to the second end of the piston rod and a second end with a gas outlet. The second head includes a receptacle communicated with the chamber in the piston rod. The second head further includes a transverse compartment extends at an angle with the receptacle, the transverse compartment including an inner end communicated with the receptacle and an outer end communicated with the gas outlet of the second end of the second head, thereby guiding gas from the gas container to the gas outlet in the second end of the second head. A pin is partially mounted in the receptacle and including an inner end extendible into the chamber in the piston rod for opening the gas container. The pin further includes a second end beyond the receptacle and actuatable by the opening means upon manual operation.

The opening means includes a lever having a first end pivotally connected to the second head and a second manual operative end. The lever further includes a recess. The first end of the pin includes a needle section and an elastic member mounted around the needle section. A knob is rotatably connected to the second head and includes an engaging piece on an outer periphery. The engaging piece is releasably engaged with the recess of the lever. The second end of the pin is normally biased by the elastic member such that the needle section is disengaged from the gas container. The lever is movable to actuate the needle section of the pin to pierce into the gas container for releasing the gas inside the gas container when the engaging piece on the knob is disengaged from the recess on the lever.

The gas guiding means of the automatic inflation device includes a nozzle plug mounted in the transverse compartment of the second head. A nozzle cap is secured to the second end of the second head, thereby preventing disengagement of the nozzle plug. The nozzle plug and the nozzle cap includes a hole through which gas from the gas container is outputted to the valve of the object to be inflated.

Alternatively, the gas guiding means of the automatic inflation device includes a nozzle plug securely mounted in the second end of the transverse compartment of the second head. The nozzle plug includes a hole through which gas from the gas container is outputted to the valve of the object to be inflated.

The gas container contains high-pressure gas therein. The manual inflation device and the automatic inflation device are both switchable to engage with valves of different types.

Other objects, advantages, and novel features of the invention will become more apparent from the following detailed description when taken in conjunction with the accompanying drawings.

BRIEF DESCRIPTION OF THE DRAWINGS

FIG. 4 is a sectional view taken along line A—A in FIG. 3;

FIG. 5 is a sectional view similar to FIG. 4, illustrating engagement between the piston and the automatic inflation device;

DETAILED DESCRIPTION OF THE PREFERRED EMBODIMENTS

Figure 1:
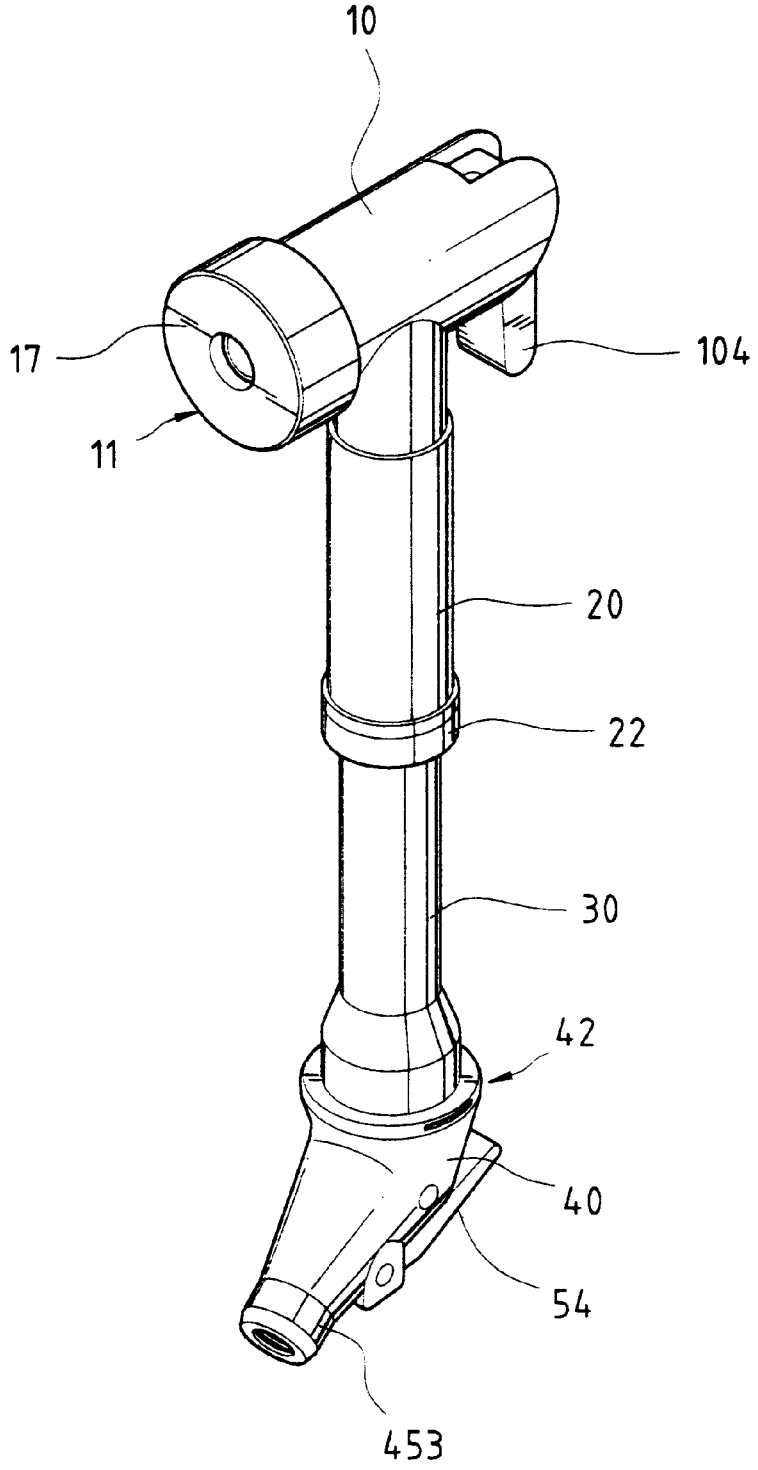
FIG. 1 is a perspective view of a first embodiment of the hand pump in accordance with the present invention.
Figure 2:
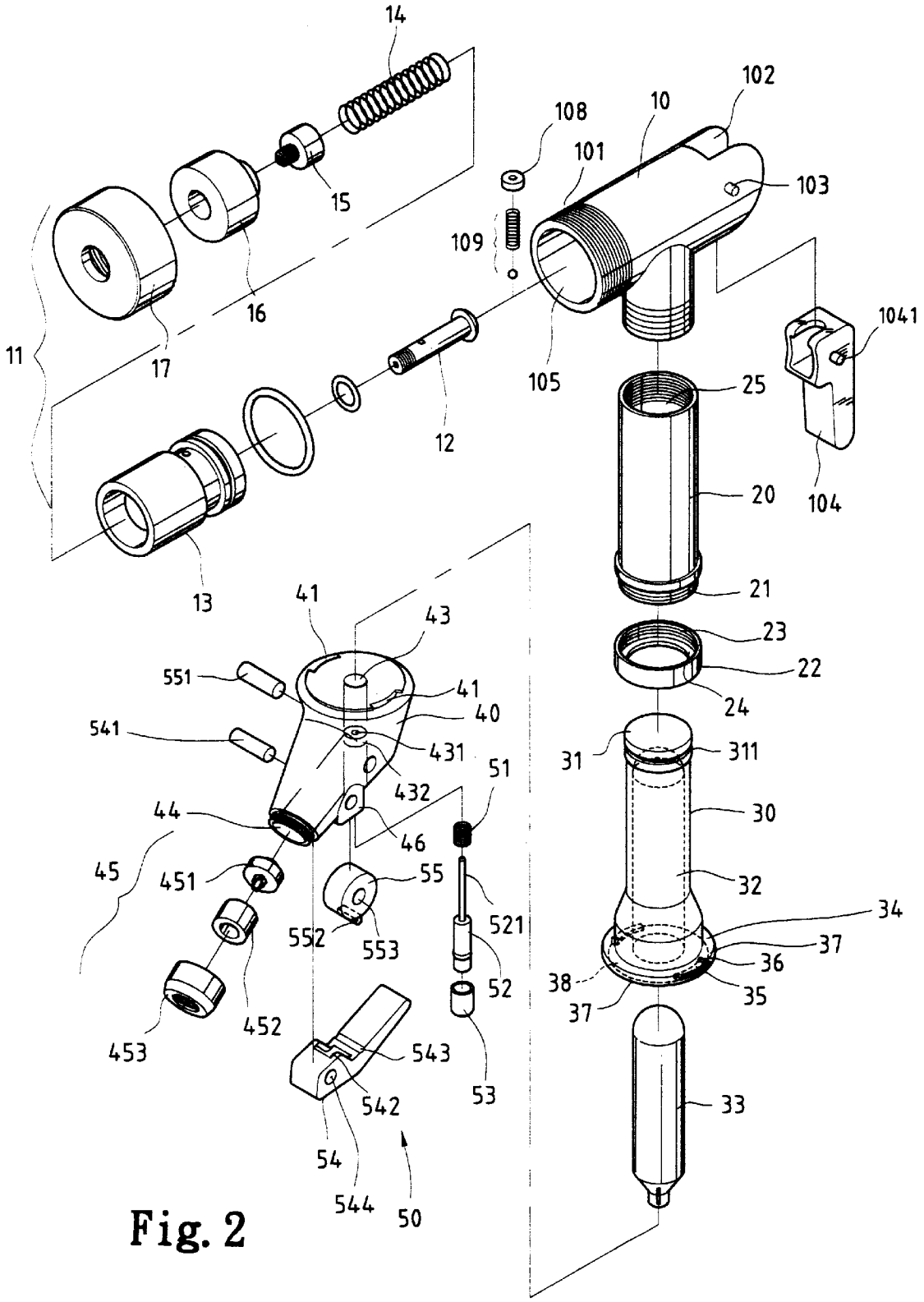
FIG. 2 is an exploded perspective view of the hand pump in accordance with the present invention.
Figure 3:
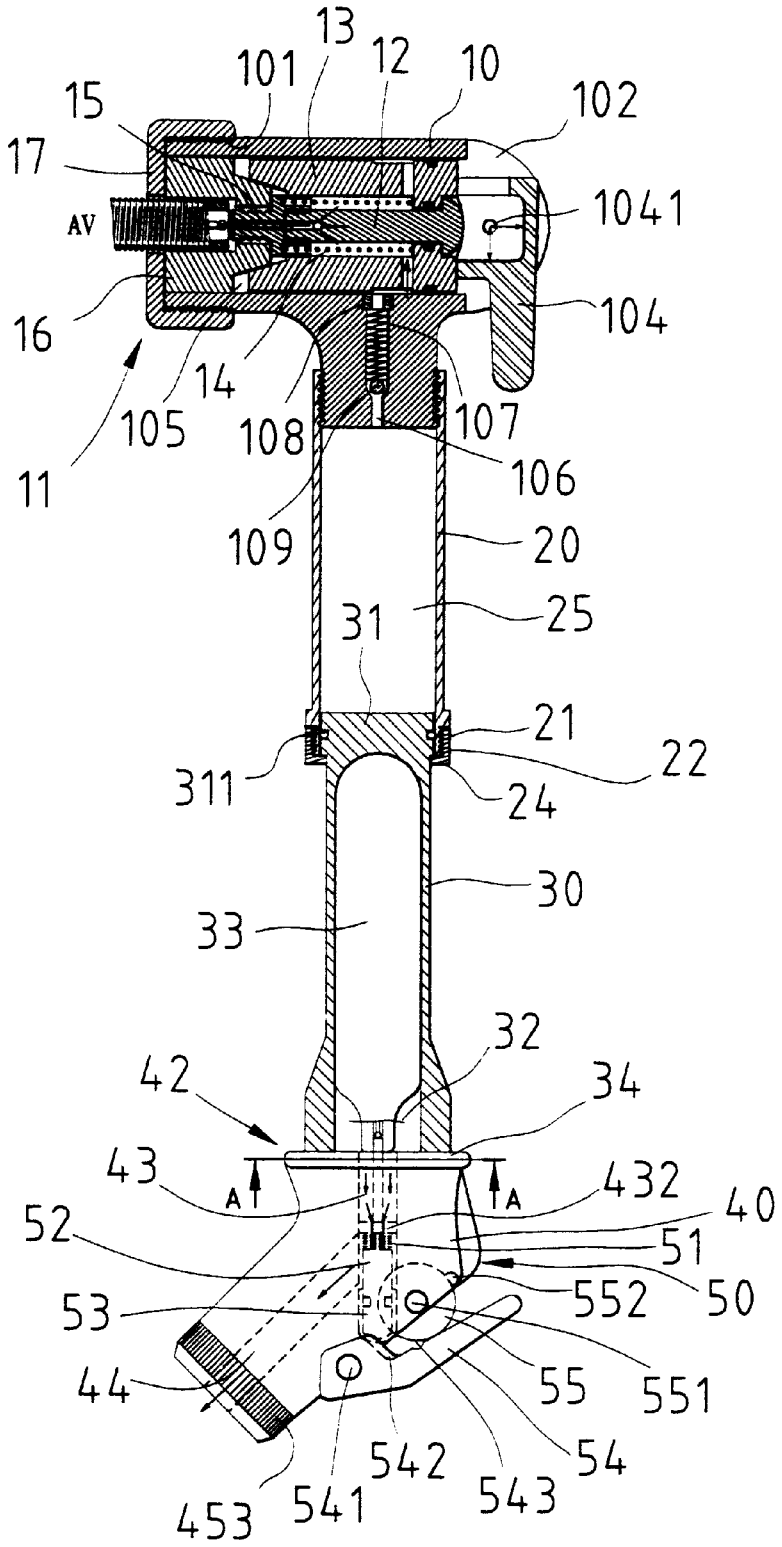
FIG. 3 is a longitudinal sectional view of the hand pump in accordance with the present invention, wherein the hand pump is in a status for automatic inflation.

Referring to FIGS. 1 through 3, a first embodiment of a hand pump in accordance with the present invention generally includes a cylinder 20 with a bore 25 therein. A head 10 is mounted to a first end of the cylinder 20 by threading engagement and includes a compartment 105 communicated with the bore 25 of the cylinder 20. The head 10 includes a passage 106 communicated between the compartment 105 of the head 10 and the bore 25 of the cylinder 20. A holed block 108 and a one-way valve 109 are mounted in the passage 106 such that air is only flowable from the bore 25 to the compartment 105 of the head 10. Mounted in the compartment 105 of the head 10 is a manual inflation device 11 that includes a tappet or pin 12, a retainer 13, an elastic member 14, a nozzle 15, a nozzle head 16, and an outer cap 17 engaged with an outer threading 101 on an end of the head 10. The manual inflation device 11 further includes a pair of lugs 102 formed on the other end of the head 10. A lever 104 includes two ears 1041 that are pivotally received in aligned receptacles 103 in the lugs 102 for manual operation to allow the manual inflation device 11 to be used with different valve types of an object (generally a bicycle wheel) to be inflated. Structure and operation of this manual inflation device 11 are conventional and therefore not further described.

A piston rod 30 includes a first end 31 reciprocatingly received in the bore 25 of the cylinder 20 and a second end beyond the second end of the cylinder 20. A sleeve ring 22 with inner threading 23 is threadedly engaged with outer threading 21 on a second end of the cylinder 20. The sleeve ring 22 includes an inner flange 24 on an inner periphery thereof for preventing disengagement of the first end 31 of the piston rod 30. The first end 31 of the piston rod 30 includes an O-ring 311 for providing the required sealing effect. The piston rod 30 includes a chamber 32 for receiving a gas container 33 therein, the gas container containing high-pressure gas (e.g., carbon dioxide) therein for automatic inflation. The second end of the piston rod 30 includes an outer flange 34 having two notch sections 35 separated by two solid sections 37. Each solid section 37 having a space 38 communicated with the notch sections 35.

An automatic inflation device is releasably attached to the second end of the piston rod 30. In this embodiment, the automatic inflation device includes a head 40 having an end with two protrusions 41 that are inserted into the notch sections 35 (FIG. 54) and then rotated through an angle into the spaces 38 in the solid sections 37 of the outer flange 34, thereby preventing disengagement between the piston rod 30 and the automatic inflation device, as shown in FIG. 5. Each solid section 37 further includes a stop 36 formed on an end to assist in the user to be aware of that the automatic inflation device is securely engaged with the second end of the piston rod 30. Namely, the user will feel that the protrusions 41 are stopped by the stops 36.

The head 40 of the automatic inflation device includes a receptacle 43 having a block 432 secured in a mediate section thereof. The head 40 further includes a transverse compartment 44 that is at an angle with the receptacle 43 and communicated with the receptacle 43. The head 40 further includes a second end with a gas outlet (not labeled). Mounted in the second end of the head 40 is a valve engaging means/gas guiding means 45 that includes a nozzle 451, a nozzle plug 452, and an outer cap 453 and that is optionally engaged with the valve of an object to be inflated. The outer cap 453 is in threading connection with the second end of the head 40. In this embodiment, the transverse compartment 44 includes an inner end communicated with the receptacle 43 and an outer end communicated with the gas outlet of the second end of the head 41, thereby guiding gas from the gas container 33 to the gas outlet in the second end of the head 44.

A pin 52 is partially mounted in the receptacle 43 and includes an inner needle end 521 that extends through an aperture 431 in the block 432. The inner needle end 521 is extendible into the chamber 32 in the piston rod 30 for penetrating into the gas container 33. The pin 52 further includes an enlarged second end beyond the receptacle 43. A spring 51 is mounted around the needle end 521 and between the block 432 and the enlarged second end (not labeled) of the pin 52.

A lever 54 has a first end pivotally connected to the second end (by means of extending a pivotal pin 541 through a pinhole 544 of the lever 54) and a second manual operative end. The lever 54 further includes a recess 542 and a depression 543. A cap 53 is received in an outer section of the receptacle 43 and attached to the second end of the pin 52. A knob 55 is rotatably connected to the head 40 (by means of extending a pivotal pin 551 through a pinhole 553 in the knob 55) and includes an engaging piece 552.

Figure 6:
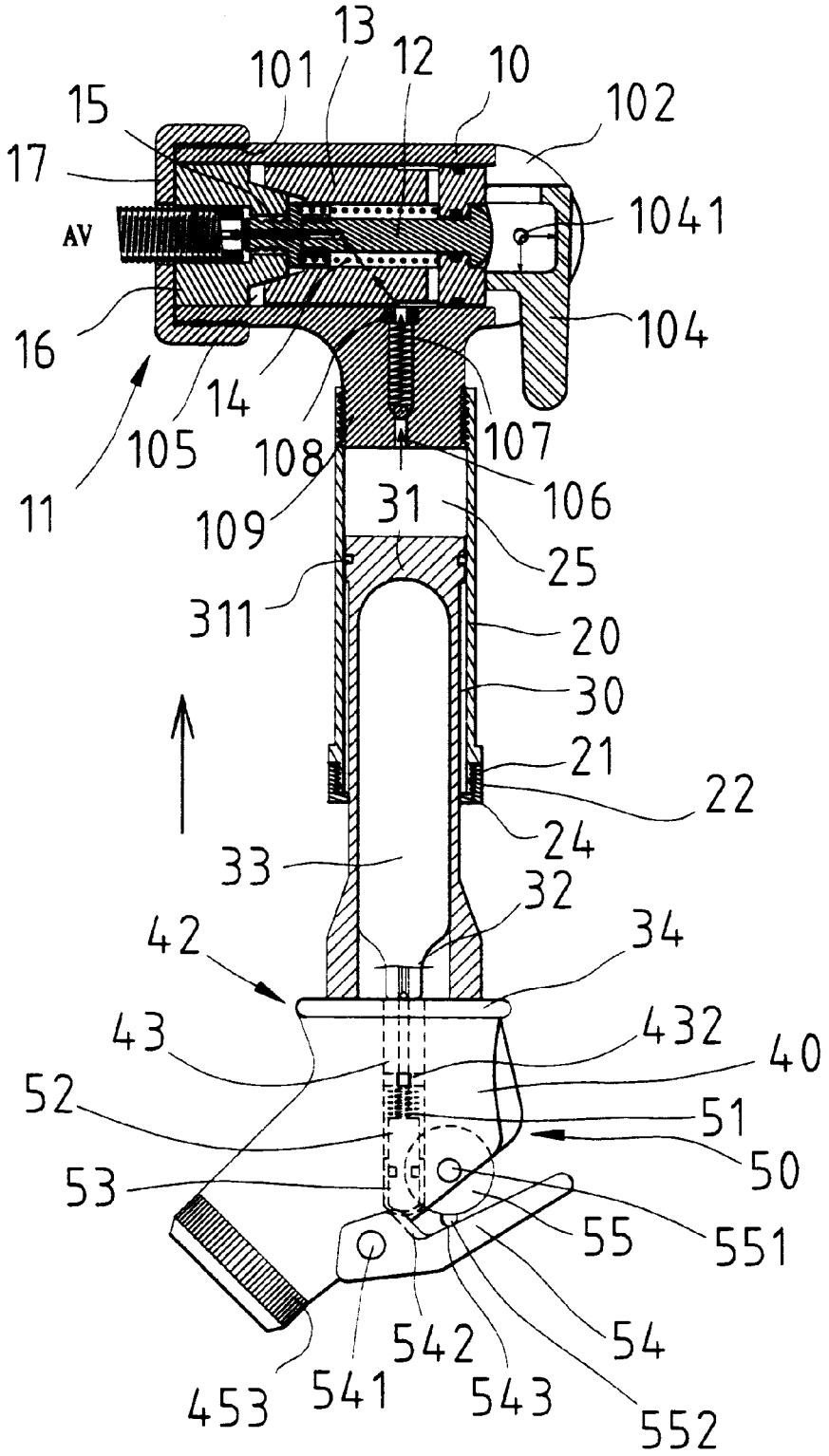
FIG. 6 is a sectional view similar to FIG. 3, wherein the hand pump is in a status for manual inflation operation.

The lever 54, the pin 52, and the knob 55 together form a means 50 for controlling opening of the gas container 33. Referring to FIG. 6, in normal condition, the second end of the pin 52 is normally biased outward by the spring 51 such that the cap 53 is received in the recess 542 of the lever 54. The engaging piece 552 is normally engaged with the depression 543. In this status, the user may perform usual manual inflation by means of operating the head 40 that acts as a handle for causing reciprocating movements of the piston rod 30 in the bore 25 of the cylinder 20, thereby pumping air into the valve of the object to be inflated via the manual inflation device 11.

When automatic inflation is required, the knob 55 is turned such that the engaging piece 552 disengages from the depression 543 of the lever 54. Then, the lever 54 is allowed to move toward the head 40 such that the needle 521 of the pin 52 is pierced into the gas container 33. The high-pressure gas inside the gas container 33 enters the compartment 44 via a gap between the block 432 and the peripheral wall defining the receptacle 43. Thus, automatic inflation is achieved, best shown in FIG. 3.

Figure 7:
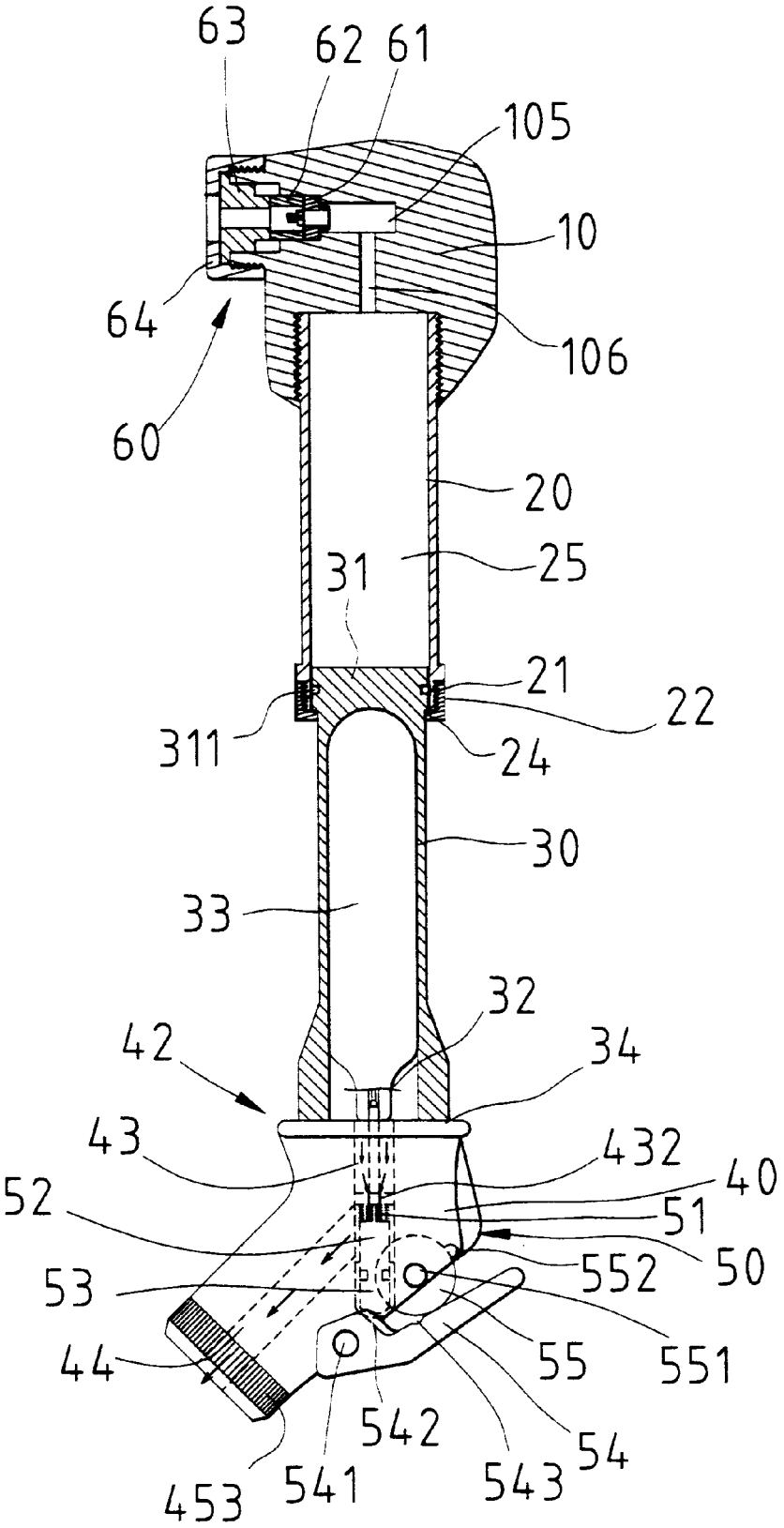
FIG. 7 is a sectional view similar to FIG. 5, wherein the hand pump is provided with another type of manual inflation device, and wherein the hand pump is in a status for automatic inflation.
Figure 8:
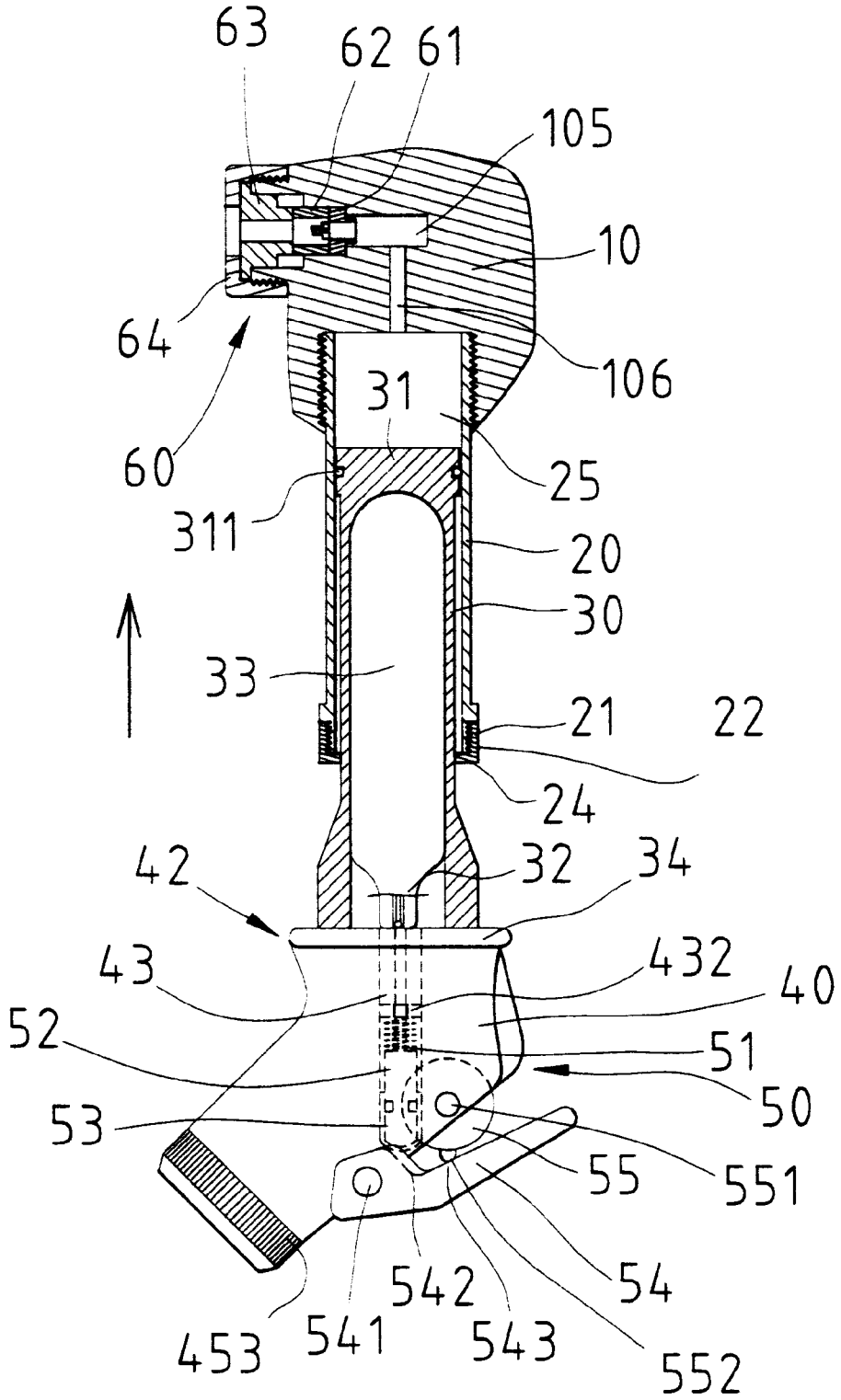
FIG. 8 is a sectional view similar to FIG. 7, wherein the hand pump is in a status for manual inflation operation.

FIG. 7 illustrates a different manual inflation device 60 that includes a nozzle head 61, a nozzle 62, a nozzle plug 63, and an outer cap 64. Structure and operation of the inflation device 60 are also conventional and therefore not described in detail. The hand pump in FIG. 7 is in a status for automatic inflation that is identical to operation in the embodiment in FIG. 3. The hand pump in FIG. 8 is in a status for manual operation.

Figure 9:
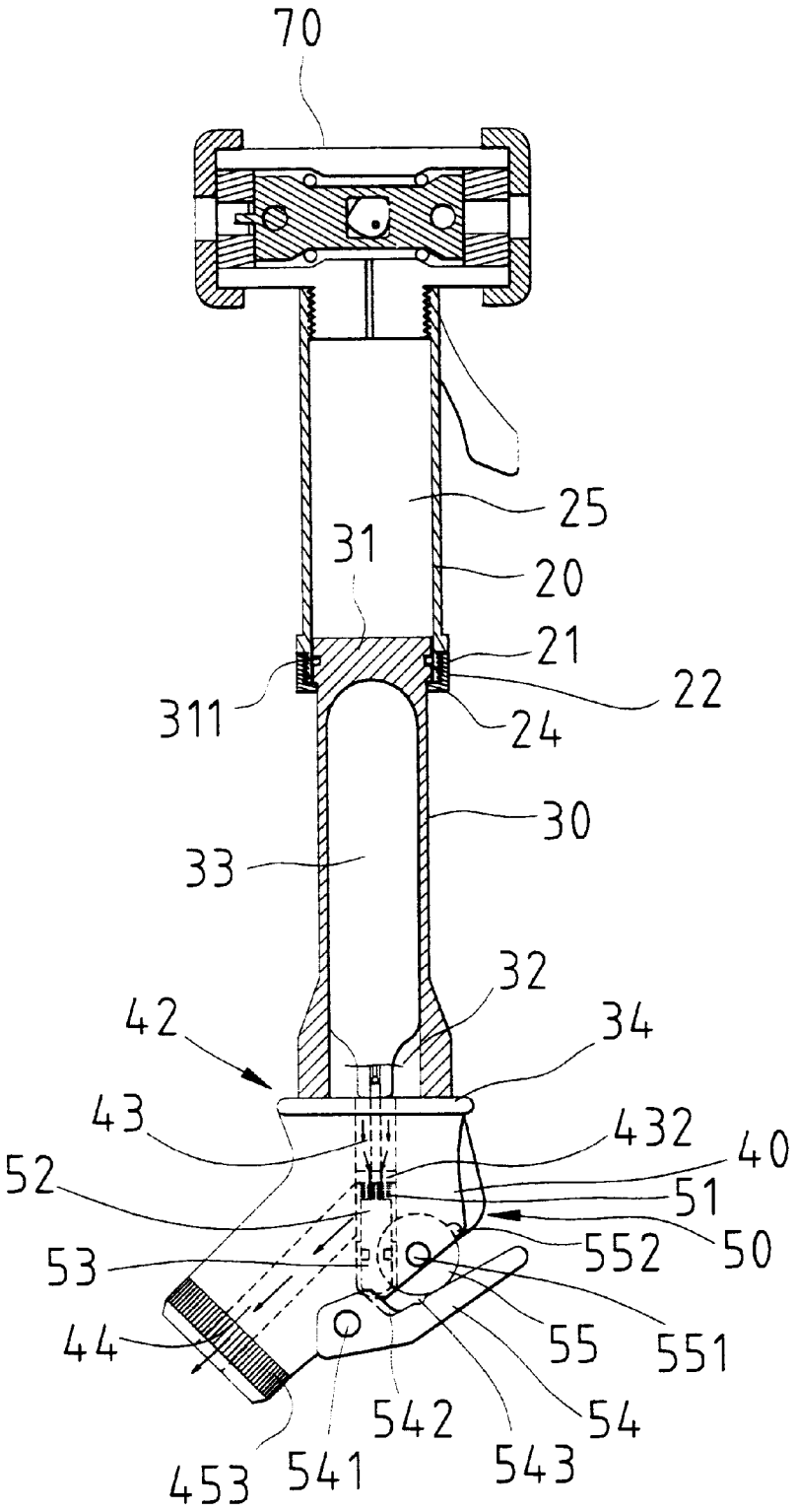
FIG. 9 is a sectional view similar to FIG. 3, wherein the hand pump is provided with another type of manual inflation device, and wherein the hand pump is in a status for automatic inflation.
Figure 10:
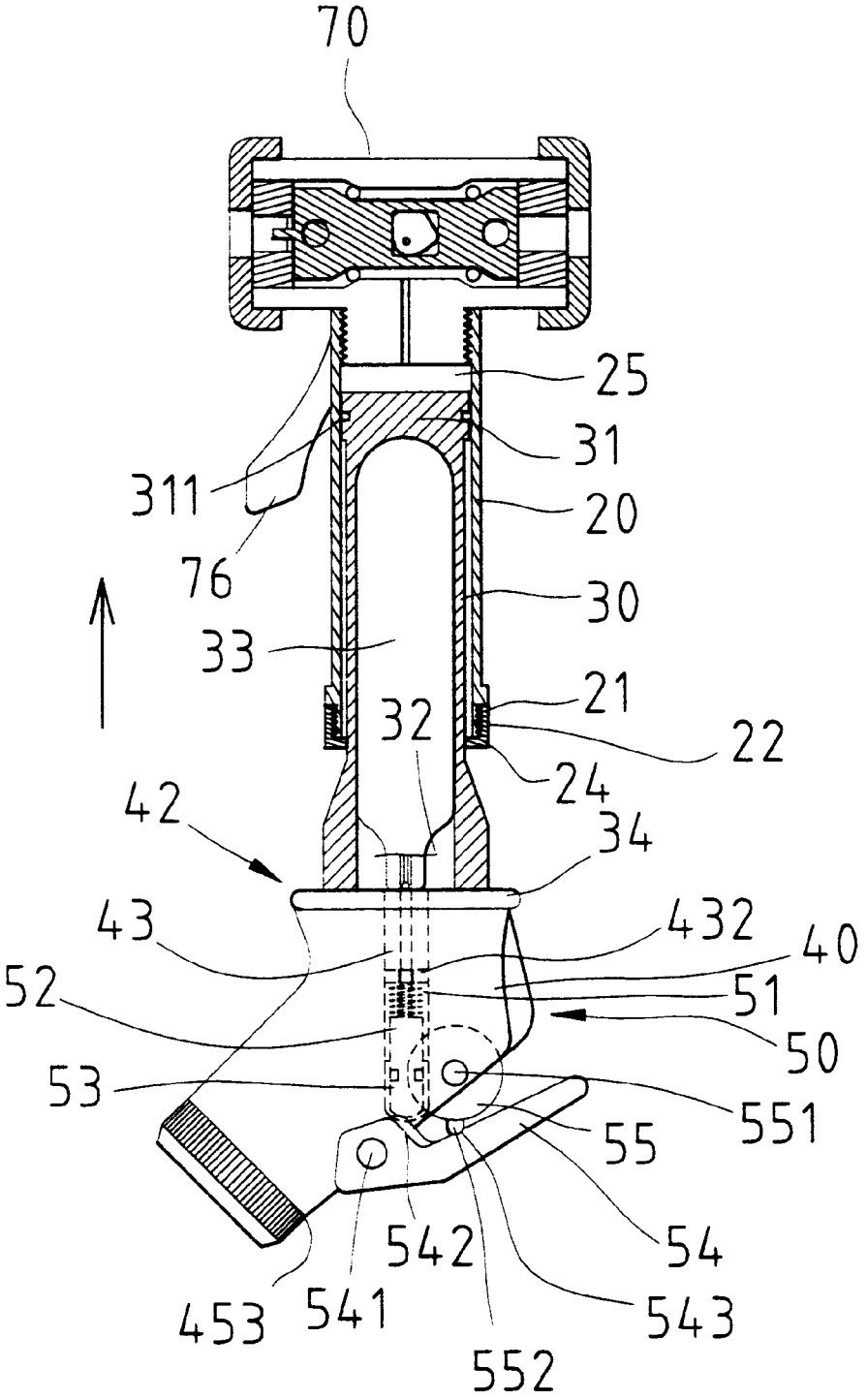
FIG. 10 is a sectional view similar to FIG. 9, wherein the hand pump is in a status for manual inflation operation.

FIG. 9 illustrates a different manual inflation device 70 for engaging with different tire valves. Detailed structure and corresponding operation have been disclosed in U.S. Pat. No. 5,645,100 issued on Jul. 8, 1997 to Chuang et al., which is incorporated herein for reference. The hand pump in FIG. 9 is in a status for automatic inflation that is identical to operation in the embodiment in FIG. 3. The hand pump in FIG. 10 is in a status for manual operation.

Figure 11:
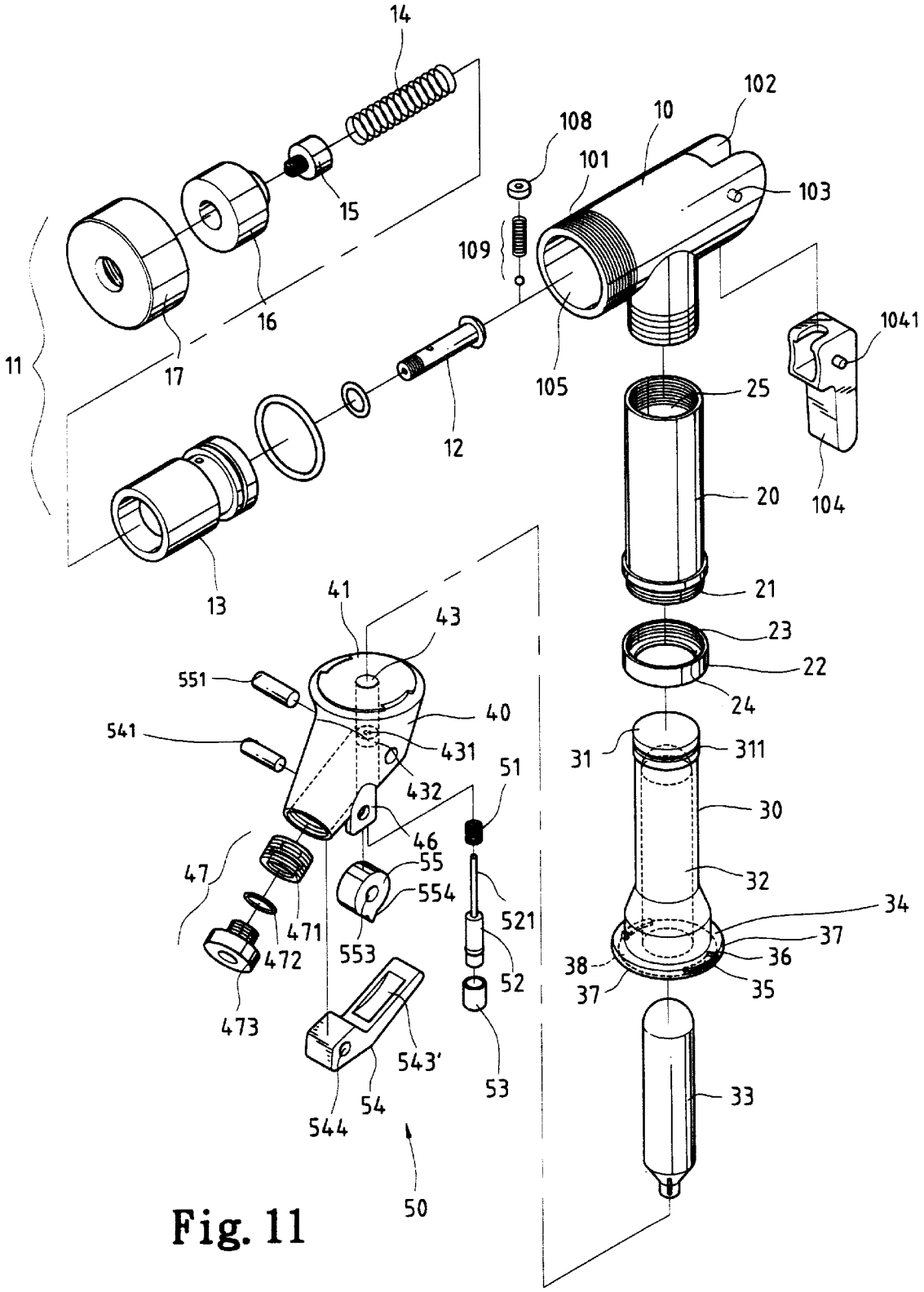
FIG. 11 is an exploded perspective view of a second embodiment of the hand pump in accordance with the present invention.
Figure 12:
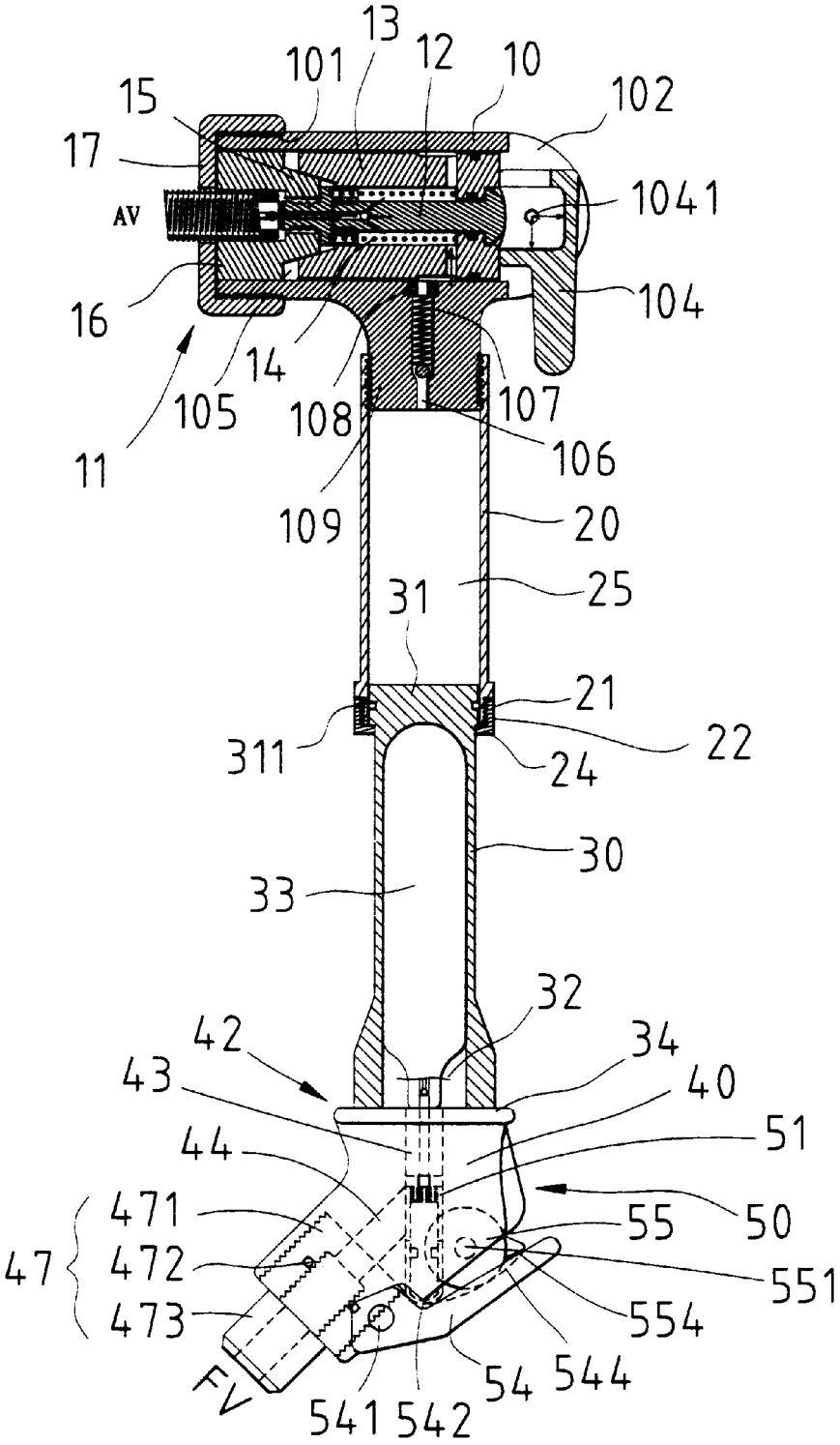
FIG. 12 is a longitudinal sectional view of the hand pump in FIG. 11, wherein the hand pump is in a status for automatic inflation.

Referring to FIGS. 11 and 12 that show a second embodiment of the automatic inflation device of the hand pump in accordance with the present invention. Except for the valve engaging means/gas guiding means (now designated by 47), the lever 54, and the knob 55, the automatic inflation device in this embodiment is substantially the same as that disclosed in the embodiment in FIGS. 1 through 3. In this embodiment, the valve engaging means/gas guiding means 47 includes a nozzle plug 471 mounted in the transverse compartment 44 of the head 40. A nozzle cap 473 is threadedly engaged to the second end of the head 40, thereby preventing disengagement of the nozzle plug 471. Each of the nozzle plug 471 and the nozzle cap 473 includes a hole (not labeled) through which gas from the gas container 33 is outputted to the valve of the object to be inflated. An O-ring 472 is mounted in the nozzle plug 471 to provide the required sealing effect. The lever 54 in this embodiment has a recess 543', and the knob 55 has an engaging protrusion 554.

Figure 13:
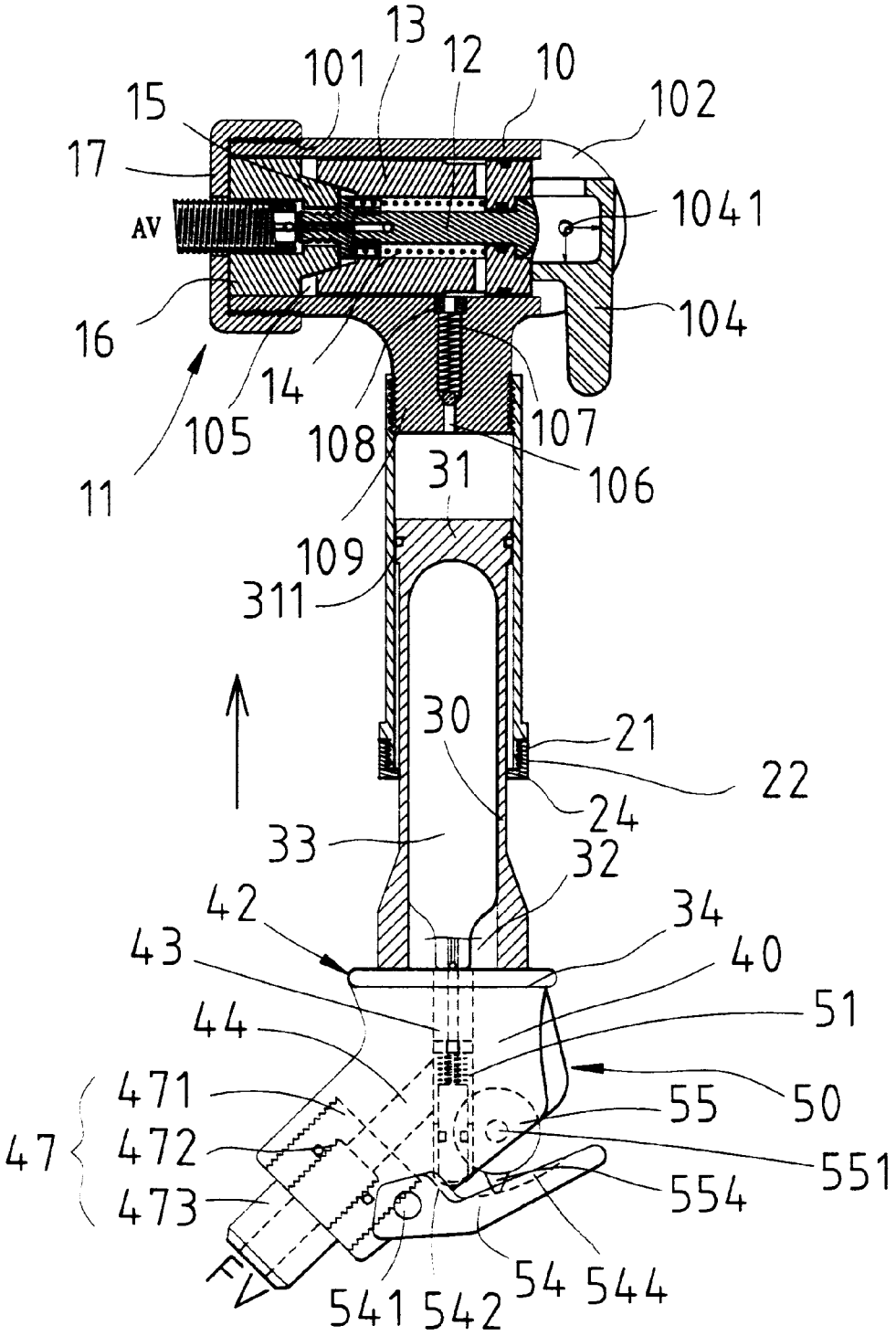
FIG. 13 is a sectional view similar to FIG. 12, wherein the hand pump is in a status for manual inflation operation to a French valve.
Figure 14:
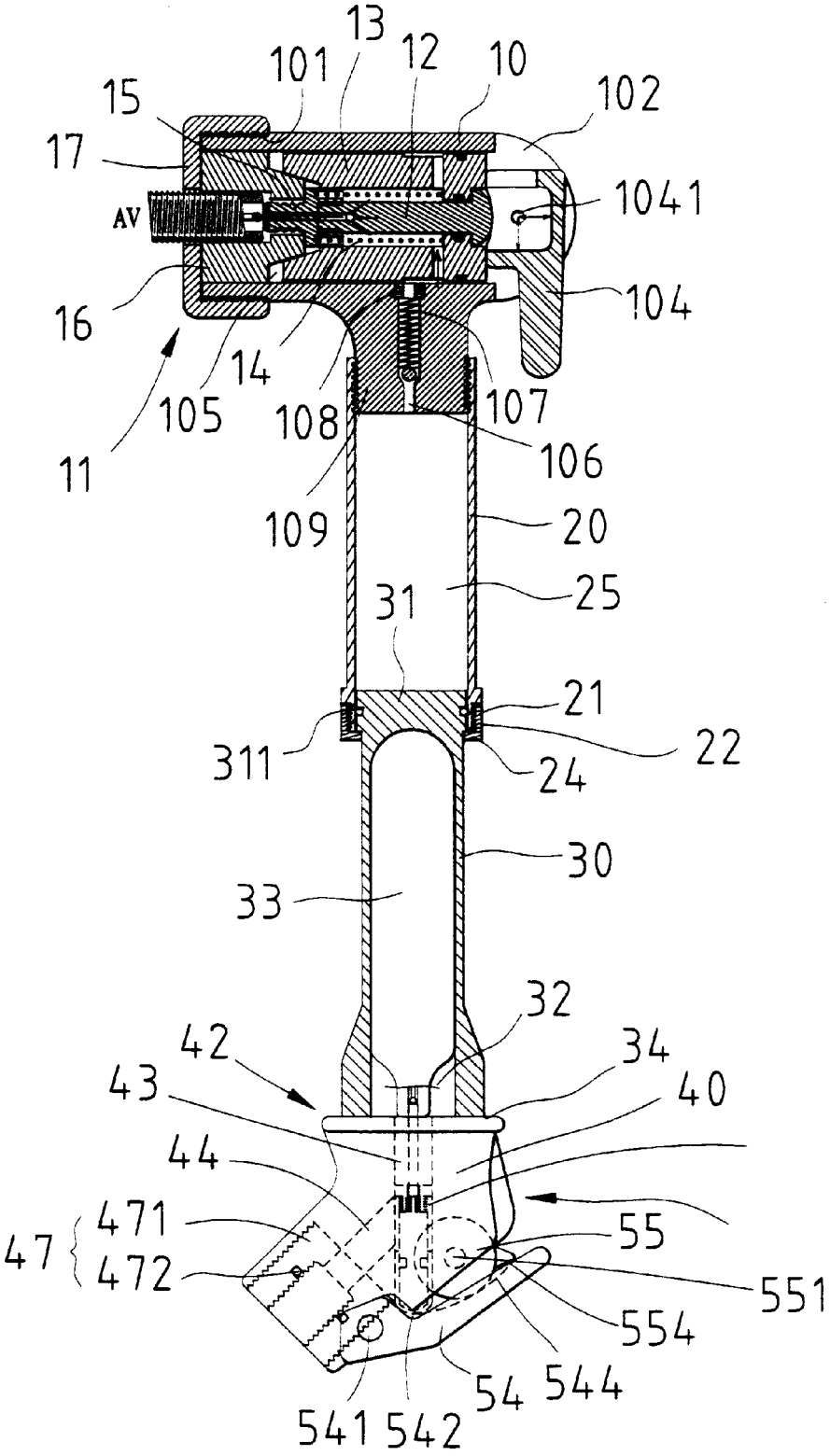
FIG. 14 is a sectional view similar to FIG. 12, wherein a nozzle cap of the automatic inflation device and wherein the hand pump is in a status for automatic inflation.
Figure 15:
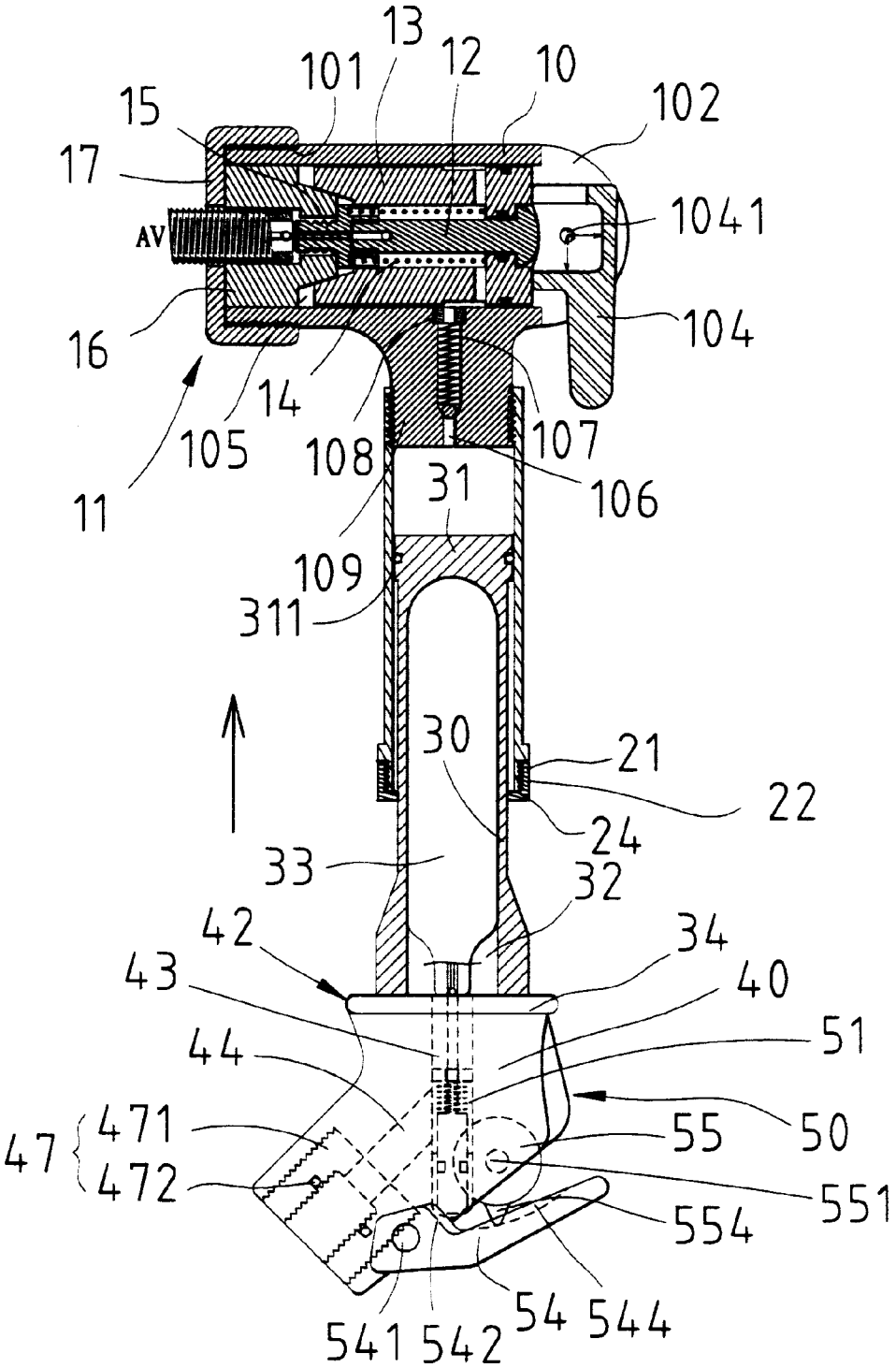
FIG. 15 is a sectional view similar to FIG. 14, wherein the hand pump is in a status for manual inflation operation to an American valve.

The hand pump in FIG. 12 is in a status for automatic inflation that is identical to operation in the embodiment in FIG. 3. The hand pump in FIG. 13 is in a status for manual operation. In addition, the nozzle cap 473 allows the hand pump to inflate a so-called French valve FV. Referring to FIGS. 14 and 15, when the nozzle cap 473 is removed, the hand pump in FIG. 15 is in a status allowing manual inflation to a so-called American valve (AV). The hand pump in FIG. 14 is in a status for automatic inflation (to the American valve AV) that is identical to operation in the embodiment in FIG. 3.

According to the above description, it is appreciated that the hand pump of the invention may automatically or manually inflate the valve of the object to be inflated. Thus, the hand pump can be used even if the user forgot to replace a new gas container after previous use. In addition, the manual inflation device and/or the automatic are switchable to engage with valves of different types.

Although the invention has been explained in relation to its preferred embodiment, it is to be understood that many other possible modifications and variations can be made without departing from the spirit and scope of the invention as hereinafter claimed.

What is claimed is:

1. A hand pump comprising:

a cylinder including a first end and a second end, the cylinder further including a bore therein;

a head mounted to the first end of the cylinder and including a compartment communicated with the bore of the cylinder;

a piston rod including a first end reciprocatingly received in the bore of the cylinder and a second end beyond the second end of the cylinder, the piston rod including a chamber for receiving a gas container therein;

an automatic inflation device attached to the second end of the piston rod, the automatic inflation device including:

a valve engaging means adapted to be optionally engaged with a valve of an object to be inflated, means for opening the gas container in the chamber of the piston rod; and means for guiding gas from the gas container to the valve; and a manual inflation device mounted in the head and adapted to be optionally engaged with the valve of the object to be inflated;

whereby the automatic inflation device is capable of acting as a handle to proceed with manual inflation to the valve of the object to be inflated via the manual inflation device.

2. The hand pump as claimed in claim 1, wherein the second end of the cylinder includes an inner flange for preventing disengagement of the first end of the piston rod from the cylinder.

3. The hand pump as claimed in claim 1, wherein the cylinder includes a sleeve ring threadedly engaged on the second end thereof and through which the piston rod extends, the sleeve ring including an inner flange for preventing disengagement of the first end of the piston rod.

4. The hand pump as claimed in claim 1, wherein the automatic inflation device is releasably engaged with the second end of the piston rod.

5. The hand pump as claimed in claim 1, wherein the second end of the piston rod includes an outer flange having two notch sections separated by two solid sections, each said solid section having a space communicated with the notch sections, the automatic inflation device including an end with two protrusions that are inserted into the notch sections and then rotated through an angle into the spaces in the solid sections of the outer flange, thereby preventing disengagement between the piston rod and the automatic inflation device.

6. The hand pump as claimed in claim 1, wherein the automatic inflation device includes a second head having a first end attached to the second end of the piston rod and a second end with a gas outlet, the second head including a receptacle communicated with the chamber in the piston rod, the second head further including a transverse compartment extends at an angle with the receptacle, the transverse compartment including an inner end communicated with the receptacle and an outer end communicated with the gas outlet of the second end of the second head, thereby guiding gas from the gas container to the gas outlet in the second end of the second head, a pin being partially mounted in the receptacle and including an inner end extendible into the chamber in the piston rod for opening the gas container, the pin further including a second end beyond the receptacle and actuatable by the opening means upon manual operation.

7. The hand pump as claimed in claim 6, wherein the opening means including a lever having a first end pivotally connected to the second head and a second manual operative end, the lever further including a recess, the first end of the pin including a needle section and an elastic member mounted around the needle section, a knob being rotatably connected to the second head and including an engaging piece on an outer periphery, the engaging piece being releasably engaged with the recess of the lever, wherein the second end of the pin is normally biased by the elastic member such that the needle section is disengaged from the gas container, and wherein the lever is movable to actuate the needle section of the pin to pierce into the gas container for releasing the gas inside the gas container when the engaging piece on the knob is disengaged from the recess on the lever.

8. The hand pump as claimed in claim 7, wherein the gas guiding means of the automatic inflation device includes a nozzle plug mounted in the transverse compartment of the second head, a nozzle cap being secured to the second end of the second head, thereby preventing disengagement of the nozzle plug, each of the nozzle plug and the nozzle cap including a hole through which gas from the gas container is outputted to the valve of the object to be inflated.

9. The hand pump as claimed in claim 7, wherein the gas guiding means of the automatic inflation device includes a nozzle plug securely mounted in the second end of the transverse compartment of the second head, the nozzle plug including a hole through which gas from the gas container is outputted to the valve of the object to be inflated.

10. The hand pump as claimed in claim 1, wherein the gas container contains high-pressure gas therein.

11. The hand pump as claimed in claim 1, wherein the manual inflation device is switchable to engage with valves of different types.

12. The hand pump as claimed in claim 1, wherein the automatic inflation device is switchable to engage with valves of different types.

* * * * *